United States Patent [19]

Foster

[11] 4,186,502

[45] Feb. 5, 1980

[54] SCENT DISPERSING BOOT

[75] Inventor: Lloyd B. Foster, Sturgeon Bay, Wis.

[73] Assignee: The Bootmakers of Sturgeon Bay, Inc., Sturgeon Bay, Wis.

[21] Appl. No.: 894,818

[22] Filed: Apr. 10, 1978

[51] Int. Cl.[2] ..... A43B 23/00

[52] U.S. Cl. ..... 36/136; 36/1; 43/1

[58] Field of Search ..... 36/136, 1, 3 R, 3 A; 43/1; 424/84; 128/574; 2/94

[56] References Cited

U.S. PATENT DOCUMENTS

| | | | |
|---|---|---|---|
| 1,213,036 | 1/1917 | Taylor, Jr. | 36/136 X |
| 1,952,409 | 3/1934 | Berg | 36/1 X |
| 2,604,707 | 7/1952 | Hicks | 36/3 R |
| 2,712,700 | 7/1955 | Solomon | 36/1 |
| 3,046,192 | 7/1962 | Bilyen | 43/1 X |

FOREIGN PATENT DOCUMENTS

| | | | |
|---|---|---|---|
| 245353 | 11/1946 | Switzerland | 36/1 |

*Primary Examiner*—James Kee Chi

[57] ABSTRACT

A scent dispersing means, e.g., for deer lure, comprising an absorbent pad adapted to be impregnated with scent and held within a pocket in a boot, the pocket having ventilating means for communicating the scent to the air. In preferred embodiments the pad is resilient and the pocket is located above the heel in the backstrap so as to flex as the wearer walks.

8 Claims, 2 Drawing Figures

SCENT DISPERSING BOOT

BACKGROUND OF THE INVENTION

This invention relates to dispersing scent into the air, e.g., deer lure.

There is a common requirement, e.g., by hunters and naturalists, to be able to disperse scent into the air to conceal their own scent and, particularly by hunters, to attract animals. Because such persons must be able to move about, it is desirable that the dispersing means be associated with the person of the hunter, concealing the hunter himself, and his scent trail, rather than, e.g., consisting of scented baits located about a limited area. It is further desirable that the scent not contaminate the person or clothing of the hunter, e.g., by coming into contact with or being applied to the hunter's clothing, and that fresh secnt be automatically dispersed.

SUMMARY OF THE INVENTION

I have discovered a scent dispersing means comprising an absorbent pad adapted to be impregnated with scent and held in a pocket in a boot, the pocket having ventilating means for communicating the scent to the air. In preferred embodiments, the pad is resilient and the pocket is located above the heel in the backstrap so as to flex as the wearer walks; the pocket has one or more holes to allow greater dispersion of the scent; and the pocket has an access slot to allow the pad to be replaced.

DESCRIPTION OF THE PREFERRED EMBODIMENT

We turn now to a description of the preferred embodiment of the invention, after first briefly describing the drawings.

DRAWINGS

STRUCTURE

Figure 1:
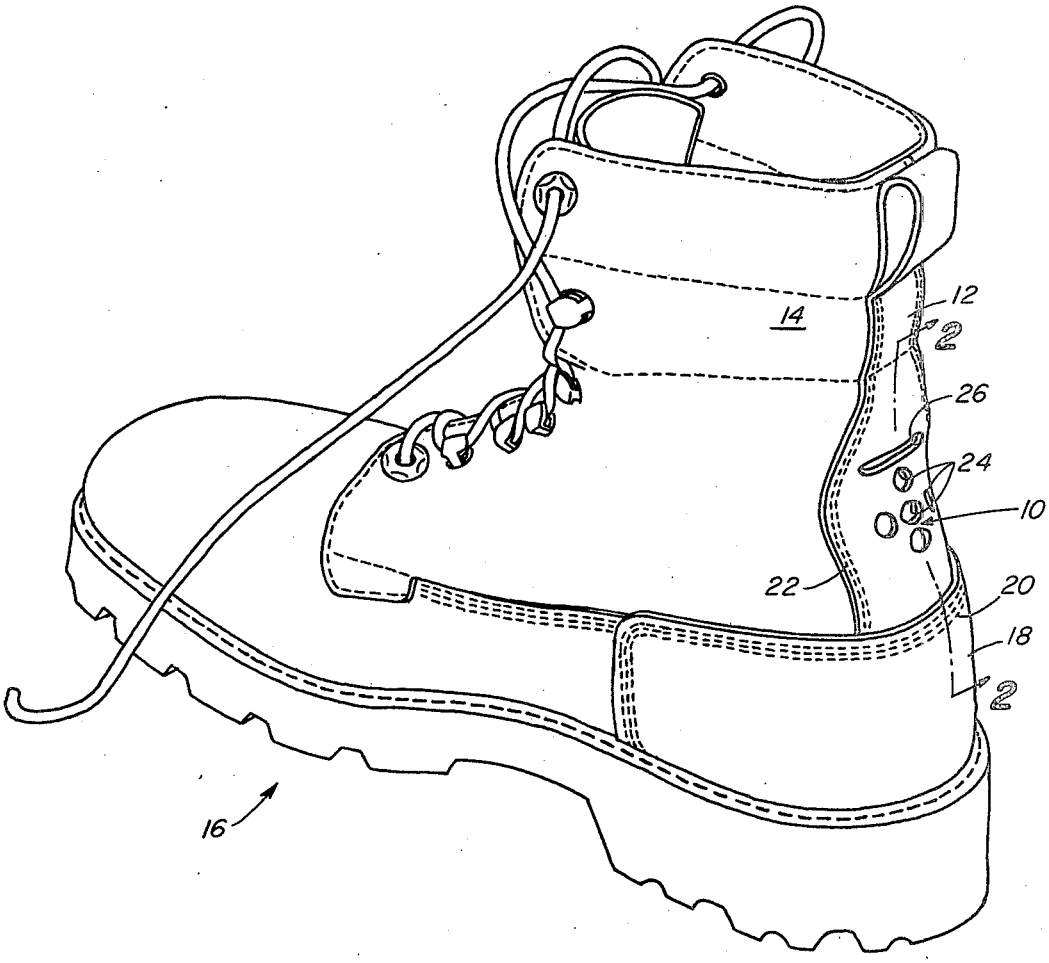
FIG. 1 is a perspective view of the boot showing the pocket.
Figure 2:
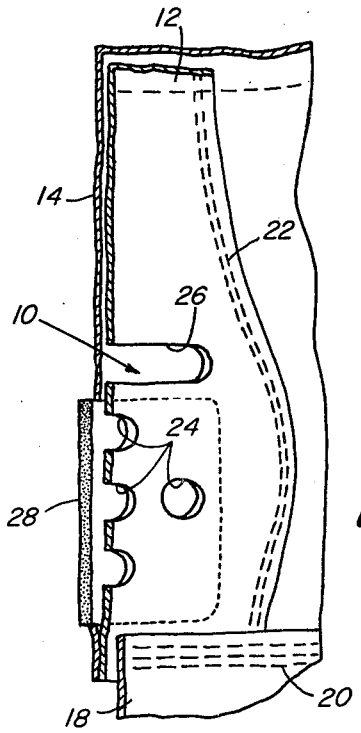
FIG. 2 is a sectional view, partially broken away, taken along 2—2 of FIG. 1, showing the pocket with the pad installed.

Referring to FIGS. 1 and 2, pocket 10 ($1\frac{5}{8}$ inches) wide by 2 inches high) is located between backstrap 12 and quarter 14 of boot 16 and above counter (or heel) pocket 18 where the boot flexes as the wearer walks. The pocket is formed by a widening of the backstrap in this area and is bounded on the bottom by stitching 20 of the counter, on the sides by backstrap stitching 22, and at the top by the narrowing of the backstrap to a width of $\frac{3}{4}$ inch. Ventilating holes 24 (3/16 inch diameter) and access slot 26 ($\frac{1}{8}$ inch high by $1\frac{1}{8}$ inches wide) are located in the backstrap, with the slot at the top of the pocket and the holes in the wall of the pocket.

Resilient, absorbent foam pad 28 (1 inch wide by $1\frac{3}{4}$ inches long and $\frac{1}{8}$ inch thick) is impregnated with scent and held within the pocket.

OPERATION

Boot 16 is constructed to be worn in the same manner as a conventional boot, with the scent pocket and pad features not interfering with the comfort and longevity of the boot. When the wearer wishes to disperse scent, a pad impregnated with the scent is inserted into the pocket through the slot and the wearer continues with his normal activities.

The alternate compression and relaxation of the pocket and pad due to the flexing of the boot as the wearer walks causes air to circulate around the pad, through the holes and slot, to automatically disperse fresh scent into the air. When the scent is no longer desired, or the pad is worn, or the scent exhausted, the pad is removed or recharged or replaced as desired.

Other embodiments are within the following claims.

I claim:

1. An improved boot construction, wherein the improvement comprises a scent dispersing means comprising:

a pocket on the exterior of said boot, and a resilient absorbent pad adapted to be impregnated with scent and held within said pocket, said pocket having ventilating means communicating between said pad and the exterior of said boot, said pocket being located in a portion of said boot that flexes as the wearer walks, said flexing of said pocket causing said pad to alternately compress and relax, thereby causing air to circulate around said pad and through said venting means to disperse scent outside said boot.

2. The boot construction of claim 1 wherein said boot includes a counter pocket, a quarter portion above said counter pocket, and a backstrap fastened to the back of said quarter portion, and said pocket is located at the back of said boot and above said counter pocket.

3. The boot construction of claim 2 wherein said pocket is between said quarter and said backstrap.

4. The boot construction of claim 3 wherein said ventilating means comprises at least one hole in said backstrap.

5. The boot construction of claim 1 wherein said pocket includes access means for inserting said pad into and removing said pad from said pocket.

6. The boot construction of claim 5 wherein said access means comprises a slot.

7. The boot construction of claim 6 wherein said slot is located adjacent the top of said pocket.

8. In a boot construction including a counter pocket, a quarter portion above said counter pocket, and a backstrap fastened to the back of said quarter portion, the improvement comprising a scent dispersing means comprising:

a scent carrying pocket on the exterior of said boot, said quarter portion and said backstrap defining the walls of said scent pocket, and the upper edge of said counter pocket and a narrow portion of said backstrap defining the bottom and the top of said scent pocket, and a resilient absorbent pad adapted to be impregnated with scent and carried within said scent pocket, said bootstrap having a slot therein to provide access to said scent pocket for inserting and removing said pad and at least one hole therein communicating between said scent pocket and the exterior of said boot to vent said scent pocket, said scent pocket flexing as the wearer walks causing said pad to alternately compress and relax, thereby causing air to circulate around said pad and through said venting means to disperse scent outside said boot.

* * * * *